United States Patent [19]

Brusasca et al.

[11] 4,290,376

[45] Sep. 22, 1981

[54] AUXILIARY TRANSPORT DEVICE FOR SEWING MACHINES

[75] Inventors: Gianfranco Brusasca, Cornaredo; Gianfranco Garzulano, Galliate, both of Italy

[73] Assignee: Rockwell-Rimoldi, S.p.A., Milan, Italy

[21] Appl. No.: 91,632

[22] Filed: Nov. 5, 1979

[30] Foreign Application Priority Data

Dec. 13, 1978 [IT] Italy ..... 30772 A/78

[51] Int. Cl.[3] ..... D05B 21/00; D05B 27/14; D05B 27/06

[52] U.S. Cl. ..... 112/121.26; 112/305; 112/322; 112/311

[58] Field of Search ..... 112/121.26, 121.27, 112/318, 322, 305, 311, 141, 152, 153

[56] References Cited

U.S. PATENT DOCUMENTS

| | | | |
|---|---|---|---|
| 1,189,007 | 6/1916 | Seymour | 112/305 |
| 1,715,119 | 5/1929 | Clarkson | 112/322 X |
| 2,199,270 | 4/1940 | Roselius et al. | 112/322 X |
| 2,670,702 | 3/1954 | Galkin | 112/121.26 |
| 3,246,616 | 4/1966 | Korioth | 112/322 |
| 4,147,120 | 4/1979 | Adamski et al. | 112/121.26 X |

FOREIGN PATENT DOCUMENTS

| | | | |
|---|---|---|---|
| 1159889 | 7/1969 | United Kingdom | 112/141 |

*Primary Examiner*—H. Hampton Hunter

[57] ABSTRACT

An auxiliary transport device for sewing machines utilized to attach bands to the edge of a workpiece having a pair of spaced roller members disposed in frictional engagement with a band attached to the workpiece and simultaneously rotated incrementally for advancing the workpiece away from the sewing zone. A compensating roller is mounted co-axial with one of the pair of spaced roller members and incrementally rotated therewith in a location to frictionally engage and advance that portion of the workpiece extending from the band. The compensating roller is capable of yielding in a vertical direction without effecting the position of the roller with which it is operatively associated and provides a means for effectively accommodating portions of the workpiece varying in thickness as a result of attachments such as loops, pockets and the like.

5 Claims, 1 Drawing Figure

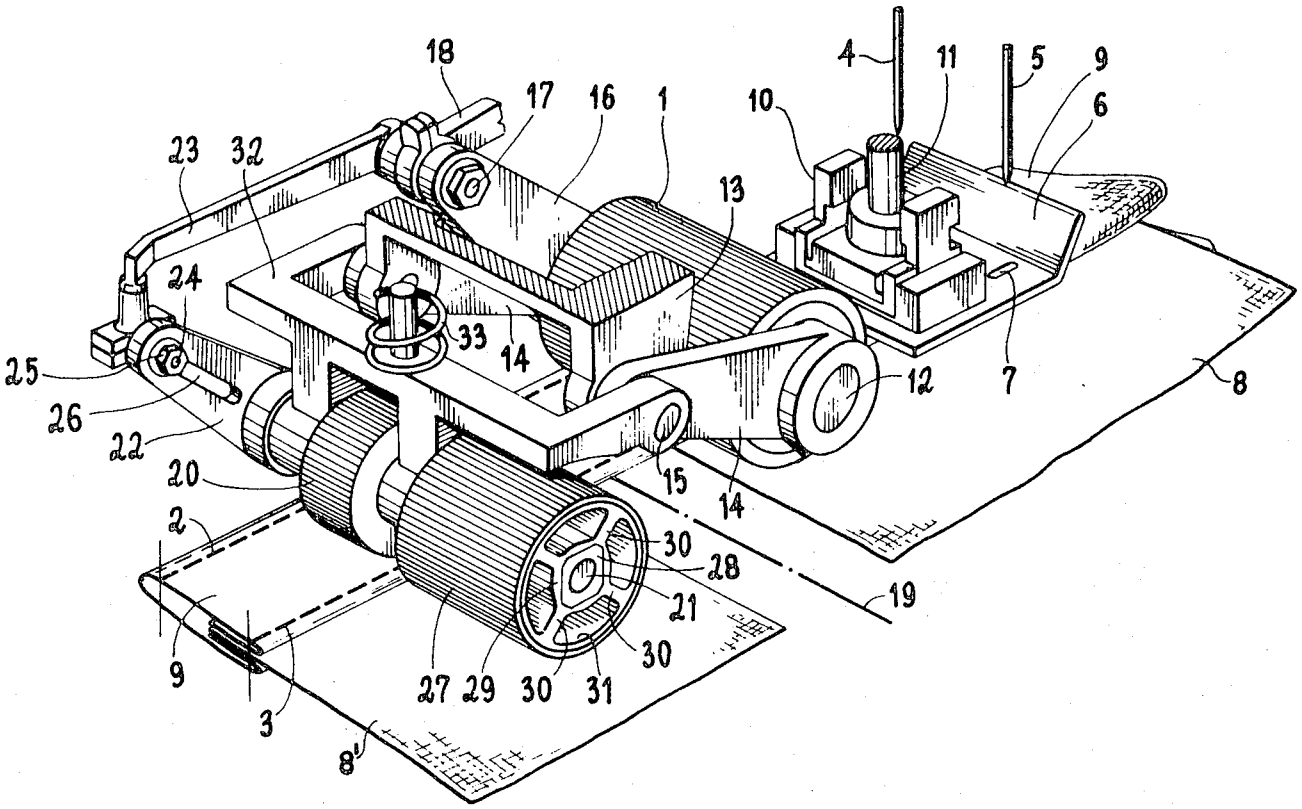
8
9
6
5
7
11
12
4
19
10
13
14
28
1
15
30
21
30
16
31
17
14
30
33
29
18
27
8'
3
32
23
24
20
2
9
22
26
25

AUXILIARY TRANSPORT DEVICE FOR SEWING MACHINES

BACKGROUND OF THE INVENTION

The present invention pertains to an improved auxiliary transport device for sewing machines having a detaching knife disposed downstream of said auxiliary transport device and with a stretching means mounted slightly beyond said detaching knife for maintaining a partially sewn garment, hereinafter referred to as workpiece, in a stretched state and in alignment with the direction of the seam being formed.

Auxiliary transport devices are well known to those conversant in the art and serve the purpose of cooperating with the conventional main transport means or so-called feed dogs of the sewing machine to effect advancing and a desired stretching of a band being sewn onto partially sewn garments such as trousers, skirts and the like. Additionally the auxiliary transport device assists in maintaining the band in alignment with the direction of sewing so that on completion of the sewing cycle the band supply will be accurately cut with the cut edge extending perpendicular to said direction of sewing.

The more common type of known auxiliary transport and stretching devices are formed by roller elements having one-way releasable clutches which are caused to perform their function in synchronization with the sewing machine's main transport means. Other forms of auxiliary transport devices are also known such as endless belts which frictionally engage a workpiece as well as movable strips or chains which are disposed in alignment with the direction of sewing so as to effect advance of a workpiece through the cutting area that is provided with a conventional type detaching knife.

The customary manner of applying a band to a workpiece is that of providing a band source formed by one or more continuous strips of fabric. The band is guided by any suitable means so as to be attached to one edge of a leading workpiece of a series of workpieces disposed one in back of the other and with sufficient space between them to facilitate separation of the sewn workpiece after each sewing cycle.

This method of applying bands to workpieces is considered desirable for it increases production by minimizing the time intervals between each sewing cycle and can be attributed to the fact that the band source requires but a single mutual procedure of inserting the end thereof into a suitable guiding apparatus located forwardly of the sewing area. The band requires no further attention by the operator until the band supply or source is exhausted and requires replenishing.

The strip or strips comprising the band supply are usually pre-formed by cutting them from a large section of material or by forming it with shorter sections of the same material from which the workpieces are cut thereby assuring a matching combination when joined one to the other. When the band supply is formed from shorter sections of material, they are joined one to another to form a continuous strip which is fed or guided to the series of workpieces in the same manner described above which is also effective in minimizing the time interval between each sewing cycle.

With both forms of band supply the band must be subjected to a predetermined amount of tension and maintained in alignment with the direction of sewing so as to prevent misalignment of the seam being formed with the edge of the workpiece and cause the detaching cut to be made perpendicular to the edges of the sewn band.

Known types of auxiliary transport devices have performed their intended function with a degree of satisfaction, but require what is considered as an excessive amount of an operator's attention in maintaining a workpiece in alignment with the direction of sewing. This can be attributed to the size and weight of a workpiece for with the greater portion of the latter being located externally of the sewing zone, that portion in which the seam is being formed, has a natural tendency to pivot away from its intended direction of travel resulting in the formation of a seam displaced from the area of the workpiece where it was intended to be formed.

An object of the present invention is to provide an improved auxiliary transport device for sewing meachines which is capable of maintaining a workpiece in positive alignment with the direction of sewing during the complete sewing cycle without special attention on the part of an operator and which will provide a clean and accurate detaching cut at appropriate location on the workpiece at the completion of each said sewing cycle.

SUMMARY OF THE INVENTION

The improved auxiliary transport device for sewing machines according to the invention is provided with a compensating transport means mounted in operative association therewith which operates in synchronization with it and on a part of the workpiece spaced from the edge to which the band is attached. This compensating transport means is provided with means for permitting it to yield a limited amount in a vertical direction and being disposed to engage a workpiece as described above, it is capable of performing its intended function in an area of a workpiece which may vary in thickness. The advantage of the compensating transport means is that of maintaining the workpiece in positive alignment with the direction of sewing during the entire seaming cycle by overcoming the above mentioned problem of a workpiece having a natural tendency to pivot and form a seam of stitches out of alignment with the intended direction of sewing.

The fact that the auxiliary transport device and the compensating transport means are operatively associated and perform their intended functions on different portions of a workpiece simultaneously and in synchronization one with the other permits the two transport means to function substantially independently so that said compensating transport means functions in a positive and effective manner on that portion of a workpiece having loops or pockets.

With the compensating transport means being provided with a means for permitting it to yield in a vertical direction, it is capable of effectively operating in planes disposed above and below that which the auxiliary transport device operates during the sewing cycle.

Further details and advantages of the present invention will become more fully apparent by reference to the appended claims and as the following detailed description proceeds in reference to the single figure of drawing which is a perspective view of a portion of a sewing machine showing the device according to the invention applied thereto.

It should be understood that the compensating transport means forming a part of the present invention could be utilized on sewing machines with conventional type auxiliary transport devices which differ from that shown and described as follows.

DESCRIPTION OF THE PREFERRED EMBODIMENT

The auxiliary transport device shown in the drawing includes among its various parts an auxiliary transport means which is formed by a roller 1 that is disposed so as to traverse the spaced seams of stitches 2 and 3 formed in the sewing zone by needles 4 and 5 respectively. These needles 4 and 5, as is well known, are disposed in operative association with the base portion of a presser foot 6 which is provided with a pair of apertures 7 one only shown, through which said needles pass when penetrating a workpiece and cooperate with the well known stitching instrumentalities located beneath said workpiece, during the stitching cycle.

The presser foot 6 includes a conventional support 10 for connecting it to a presser bar 11 and together with the main feed dogs (not shown) that are located beneath the workpiece, they provide the means of advance of said workpiece during the sewing cycle. The roller 1 of the auxiliary transport means is formed by a metal cylinder having a knurled peripheral surface which is operatively associated with a rotatably mounted roller (not shown) located below the workpiece and the machine's workpiece supporting surface and serve to assist in the advance of a workpiece during the sewing cycle. The roller 1 is mounted on a shaft 12 that is pivotably connected to a support bracket 13 mounted on the machine by means of a pair of arms 14 assembled on each end of said shaft 12 and with the opposite ends of said arms being connected to said support bracket 13 by means of a pair of pivot pins 15. The roller 1 is incrementally rotated by means of an operating lever 16 one end of which is connected to a conventional one-way releasable clutch (not shown) assembled within one end of said roller 1. The opposite end of this operating lever 16 is connected by means of a pivot pin 17 to a control lever 18 which is reciprocated by any suitable means (not shown) to effect incremental rotation of the roller 1.

Operatively associated with the auxiliary transport device a well known detaching knife (not shown) is provided and its function is schematically represented by a cutting line 19 which extends perpendicular to the band attached to the workpiece that is depicted by numeral 9.

The auxiliary transport device also includes a stretching means which is formed by a roller 20 mounted on a control shaft 21 which is disposed in spaced and parallel relation to the shaft 12 on which the roller 1 is mounted. As shown in the drawing, the cutting line 19 is located intermediate the rollers 1 and 20.

The roller 20 is also provided with a knurled outer surface and is of a width less than that of the band 9 so that it engages the band portion of the workpiece in the area intermediate the seams of stitches 2 and 3. The roller 20 also has a unidirectional clutch (not shown) mounted therein which is actuated by an operating lever 22 that is operatively connected to the control lever 18 by means of a linkage member 23. To synchronize the incremental rotative movement of rollers 1 and 20, the linkage member 23 is pivotably connected at one end to pivot pin 17 and at its opposite end to a pivot pin 24.

As shown in the drawing, the pivot pin 24 can be selectively located within the limits of a slot 26 provided in the operating lever 22 by means of lock nut 25 and provides a means whereby the velocity of roller 20 can be varied relative to roller 1 in order to obtain a desired degree of stretching force on the band portion of the workpiece.

Co-axial with roller 20, control shaft 21 has a compensating transport means mounted thereon which is formed by a roller 27 that defines a metallic cylinder having a knurled outer surface. Roller 27 is mounted on the control shaft 21 by means of a rigid hub member 28 with a resilient means interconnecting the latter with the inner surface of said roller 27. This resilient means is deformable which provides the roller 27 with means that permits limited vertical movement thereof and is thus able to accommodate those portions of the workpiece depicted by numeral 8' which may vary in thickness without varying the position of the control shaft 21 and the intended function of the roller 20 mounted thereon. The resilient means includes a central sleeve 29 which assembles on the hub member 28 and with integral and radially extending arms 30 that terminate in an integrally formed cylindrical member 31. The outer surface of the cylindrical member 31 conforms to the inner surface of the roller 27 with which it is in driving engagement.

The elements forming the resilient means may be fabricated from any suitable temporarily deformable material such as rubber which possesses sufficient elasticity to permit vertical displacement of the roller 27 when that portion of the workpiece 8' varies in thickness as a result of attachments such as loops, pockets or the like.

The position of the roller 27 on the control shaft 21 is such as to engage only that portion of the workpiece identified by numeral 8' and is of a diameter slightly greater than the roller 20 which is adapted to engage only the band portion of the workpiece which on the average has a greater thickness than the portion 8'. Roller 27 has a larger diameter so as to provide sufficient contact pressure with the workpiece while cooperating with a similar roller (not shown) that is rotatably mounted on a fixed axis disposed below the workpiece surface of the sewing machine.

A conventional type presser arm 32 is pivotably attached to the support bracket 13 by pivot pins 15 and by means of a coil spring 33 operatively associated therewith said support bracket is caused to apply a downwardly directed biasing force on the control shaft 12.

During the sewing cycle, the band 9 is caused to be advanced by the combination of the machine's feed dogs and the roller 1. Although the roller 1 is of greater length than the width of the band 9, it does not make contact with the workpiece 8 for the thickness of said band is generally greater than said workpiece 8.

The roller 20 which serves to act on the band 9 to apply a desired degree of stretching to the latter for eliminating any possible folds or wrinkles prior to cutting should when there is a parity between the diameters of rollers 1 and 20, have a peripheral velocity which is slightly greater than said roller 1.

The initial setting of roller 27 is such that its radially extending arms 20 are slightly deformed in order to provide it with sufficient frictional contact with the workpiece 8' to advance the same during the sewing cycle. This initial setting of the roller 27 is maintained by the biasing force of the presser arm 32 acting on the control shaft 21 which supports both rollers 20 and 27.

The roller 27 having a diameter that is slightly greater and with substantially more area of contact with the workpiece than that of the roller 20, provides a greater degree of advance than said roller 20. Additionally, the roller 27 is effective in maintaining the workpiece in its intended path of travel during the sewing cycle and has eliminated the aforementioned problem of the workpiece having a natural tendency of pivoting away from the direction of sewing due to the weight thereof.

When the roller 27 encounters a greater thickness in that portion of the workpiece depicted by numeral 8', it readily adapts itself to the change by further deformation of the arms 30 and does so without effecting a change in the relationship of the roller 20 with the band 9. When the radially extending arms 30 are subjected to additional deformation due to compression, they cause the roller 27 to move closer than its initial setting to the control shaft 21, thus effecting eccentric rotation thereof relative to said control shaft 21 which remains in a fixed location, with respect to the workpiece 8', which is controlled by the roller 20.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. An improved auxiliary transport device for sewing machines of the type having a pair of spaced needles with a cooperating presser foot forming a sewing zone for attaching bands to partially sewn workpieces, said transport device comprising:

(a) a support bracket (13) mounted on the sewing machine rearwardly of and in alignment with the needles and presser foot;

(b) an auxiliary transport means defining a first roller (1) extending perpendicular to the direction of sewing and pivotably attached to said support bracket (13) including;

(i) drive means for effecting incremental rotation thereof for assisting in the advance of the workpiece from the sewing zone;

(c) a stretching means for engaging the bands attached to the workpiece defining a second roller (20) spaced from and operatively connected to said first roller (1) for effecting simultaneous incremental rotation therewith;

(d) a compensating transport means defining a third roller (27) mounted co-axial and for incremental rotation with said second roller (20) for engaging and advancing that portion of the workpiece extending from the attached band, including;

(i) yielding means for effecting limited vertical movement thereof when engaging portions of the workpiece varying in thickness.

2. The improved auxiliary transport device according to claim 1 wherein said second roller (20) is mounted on a horizontally extending control shaft (21) having an operating lever (22) and a linkage member (23) interconnecting the latter with said drive means and with means interconnecting said linkage member with said operating lever for effecting a greater peripheral velocity of said roller 20 relative to said roller (1).

3. The improved auxiliary transport device according to claim 2 wherein said control shaft (21) has said third roller (27) mounted thereon in spaced relation to said second roller (20) and a spring biased presser arm (32) operatively associated therewith for continuously urging said second and third rollers (20,27) into frictional contact with the workpiece.

4. The improved auxiliary transport device according to claim 3 wherein said third roller 27 includes:

(a) a rigid hub member (28) fixed on said control shaft (21); and (b) a central sleeve (31) assembled on said hub member (28) having a plurality of integrally formed radially extending arms (30) terminating in a cylindrical member (31) disposed in driving relation with the inner surface of said third roller (27).

5. The improved auxiliary transport device according to claim 4 wherein said radially extending arms (30) are fabricated from a temporarily deformable material and define said yielding means.

* * * * *